US011126110B2

(12) United States Patent
Hayashi

(10) Patent No.: US 11,126,110 B2
(45) Date of Patent: Sep. 21, 2021

(54) IMAGE FORMING APPARATUS FOR CONTROLLING DURABILITY CORRECTION VALUE IN EXECUTION OF TONER INSTALLATION MODE

(71) Applicant: KYOCERA Document Solutions Inc., Osaka (JP)

(72) Inventor: Koichi Hayashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/106,513

(22) Filed: Nov. 30, 2020

(65) Prior Publication Data

US 2021/0173328 A1 Jun. 10, 2021

(30) Foreign Application Priority Data

Dec. 9, 2019 (JP) ..... JP2019-222206

(51) Int. Cl.
*G03G 15/10* (2006.01)
*G03G 15/08* (2006.01)

(52) U.S. Cl.
CPC ..... *G03G 15/0856* (2013.01); *G03G 15/0889* (2013.01)

(58) Field of Classification Search
CPC ..... G03G 15/0831; G03G 15/0856; G03G 15/0877; G03G 15/0889; G03G 15/553; G03G 15/556
See application file for complete search history.

(56) References Cited

U.S. PATENT DOCUMENTS 9,651,893 B2 * 5/2017 Asaka ..... G03G 15/0856

FOREIGN PATENT DOCUMENTS

JP 2017-015754 1/2017

* cited by examiner

*Primary Examiner* — Hoang X Ngo
(74) *Attorney, Agent, or Firm* — Lex IP Meister, PLLC

(57) ABSTRACT

The control unit controls supply of toner from the toner container to the developing device. The image forming apparatus performs durability correction for correcting image forming conditions in accordance with a cumulative driving time from the start of use of the developing device, a cumulative number of printed sheets, and the like. The control unit can execute a normal supply of toner from the toner container to the developing device based on the detection result of the toner amount detection sensor, and a toner installation mode in which more toner is supplied from the toner container to the developing device than the normal supply. When toner is not detected in the developing device, a durability correction value is reset and the toner installation mode is executed. When toner is detected in the developing device, the control unit executes the toner installation mode without resetting the durability correction value.

4 Claims, 5 Drawing Sheets

IMAGE FORMING APPARATUS FOR CONTROLLING DURABILITY CORRECTION VALUE IN EXECUTION OF TONER INSTALLATION MODE

INCORPORATION BY REFERENCE

This application is based upon and claims the benefit of priority from the corresponding Japanese Patent Application No. 2019-222206 filed on Dec. 9, 2019, the entire contents of which are incorporated herein by reference.

BACKGROUND

The present disclosure relates to an image forming apparatus capable of supplying toner to a developing device.

Generally, in a one-component developing type image forming apparatus using a magnetic one-component developer made of only a magnetic toner, a method of supplying (installing) toner from a toner container into a new developing device when a user replaces the developing device is known. In the image forming apparatus having the toner amount detection sensor, the amount of toner supplied from the toner container to the developing device is controlled in accordance with the output value of the toner amount detection sensor.

On the other hand, some of the developing devices to be replaced do not have an individual identification function such as an IC tag for cost reduction. In such a developing device, since it is not possible to determine whether the developing device has been replaced, or whether the developing device is new or used, the toner installation mode is executed for filling the developing device with toner regardless of whether toner is present in the developing device. That is, when the toner installation mode is started, it is not possible to confirm whether the developing device is a new one, and therefore, it is not possible to determine whether the developing device is in the toner installation mode that has been performed by replacing the developing device. As a result, when the developing device is a new one, control in accordance with the use of the developing device thereafter, so-called durability correction, may be executed, but the operation of resetting the correction value of the durability correction cannot be linked with the toner installation mode.

As such an image forming apparatus, there is known an image forming apparatus which includes a developing device, a toner container including data indicating whether the toner container is an installation toner container or a replacement toner container and including a memory for storing the value of a remaining amount related item, a replenishing unit for replenishing the toner to the developing device, a reading/writing unit for reading/writing the memory, and a control unit for gradually decreasing the current value of the remaining amount related item in accordance with the number of printed sheets, and which stores in the memory a value based on the remaining amount of toner after installation when the developing device is filled with the toner in a state where the installation toner container is attached, and a value based on the remaining amount of toner before installation when the installation toner container is attached after installation.

SUMMARY

An image forming apparatus according to an aspect of the present disclosure includes an image carrier, a developing device, a toner amount detection sensor, a toner container, and a control unit. A photosensitive layer is formed on the surface of the image carrier. The developing device includes a replaceable developing container that stores a one-component developer including a magnetic toner, and a toner bearing member that bears the toner in the developing container. The developing device forms a toner image by causing the toner to adhere to an electrostatic latent image formed on a surface of the image carrier. The toner amount detection sensor detects the amount of toner in the developing device. The toner container stores toner to be supplied to the developing device. The control unit controls replenishment of toner from the toner container to the developing device. The image forming apparatus performs durability correction for correcting image forming conditions in accordance with a cumulative driving time from the start of use of the developing device, a cumulative number of printed sheets, and the like. The control unit is configured to execute a normal supply in which toner is supplied from the toner container to the developing device based on a detection result of the toner amount detection sensor, and a toner installation mode in which a larger amount of toner than the normal supply is supplied from the toner container to the developing device. The control unit detects an amount of toner in the developing device by the toner amount detection sensor during execution of the toner installation mode, and resets a durability correction value for use in durability correction and executes the toner installation mode when the toner is not detected in the developing device, and executes the toner installation mode without resetting the durability correction value when the toner is detected in the developing device.

DETAILED DESCRIPTION

Hereinafter, embodiments of the present disclosure will be described with reference to the drawings.

Figure 1:
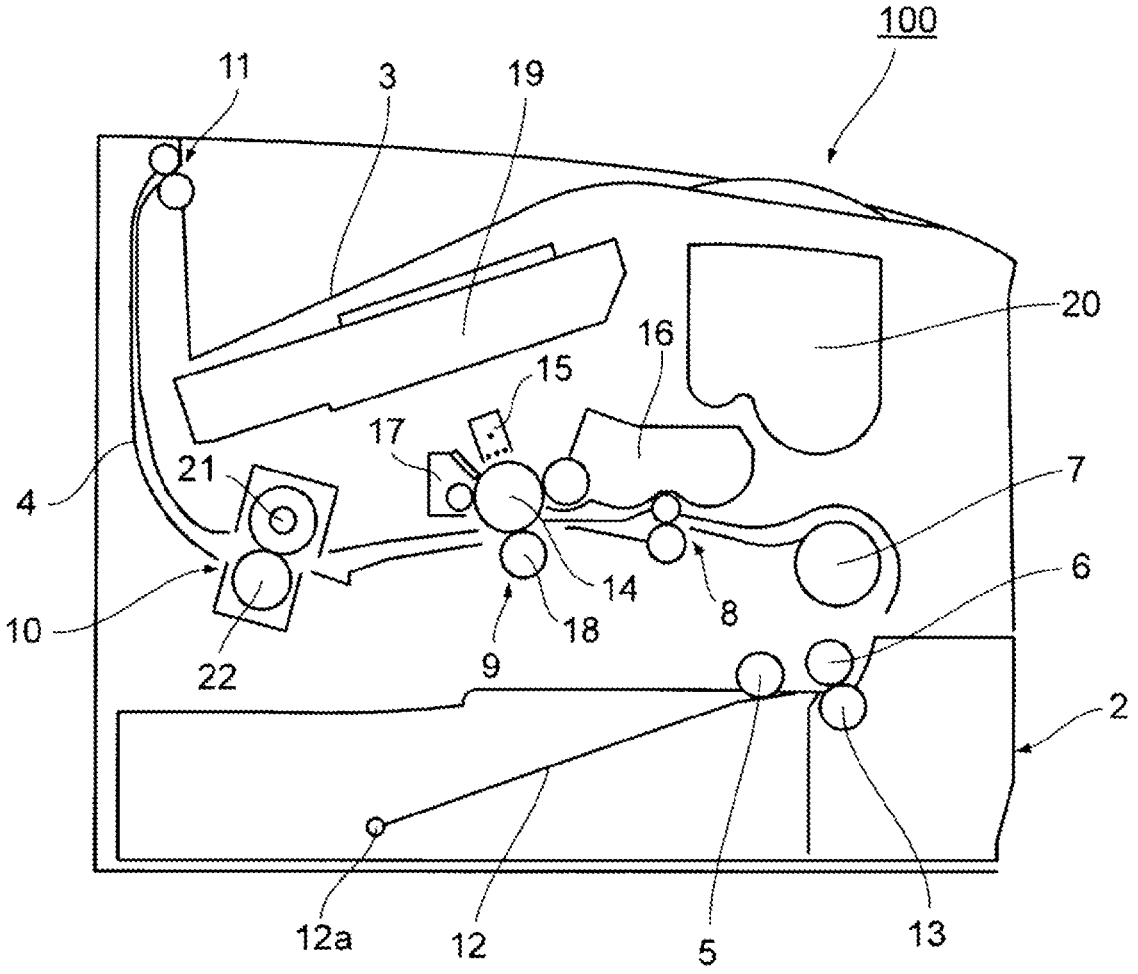
FIG. 1 is a schematic sectional view showing the overall configuration of an image forming apparatus 100 according to an embodiment of the present disclosure.

FIG. 1 is a schematic configuration of an image forming apparatus 100 according to an embodiment of the present disclosure. As shown in FIG. 1, the image forming apparatus (here, a monochrome printer) 100 is provided with a sheet feeding cassette 2 that accommodates sheets stacked in a lower portion of a main body. Above the sheet feeding cassette 2, a sheet conveyance path 4 is formed which extends substantially horizontally from the front of the main body to the rear of the main body and further extends upward to reach a sheet discharge unit 3 formed on the upper surface of the main body, and a pickup roller 5, a feed roller 6, an intermediate conveyance roller 7, a registration roller pair 8, an image forming unit 9, a fixing unit 10, and a discharge roller pair 11 are arranged in this order from the upstream side along the sheet conveyance path 4.

The sheet feeding cassette 2 is provided with a paper loading plate 12 rotatably supported with respect to the sheet feeding cassette 2 by a rotation fulcrum 12*a* provided at a rear end part in a paper conveying direction, and the paper loaded on the paper loading plate 12 is pressed by the pickup roller 5. A retard roller 13 is disposed in a front portion of the sheet feeding cassette 2 so as to be pressed against the feed roller 6. When a plurality of sheets are simultaneously fed by the pickup roller 5, the sheets are separated by the feed roller 6 and the retard roller 13, and only the uppermost 1 sheet is conveyed.

The sheet separated by the feed roller 6 and the retard roller 13 is conveyed to the registration roller pair 8 after the conveyance direction is changed to the rear of the apparatus by the intermediate conveyance roller 7, and is conveyed to the image forming unit 9 after the timing is adjusted by the registration roller pair 8.

The image forming unit 9 forms a predetermined toner image on a sheet by an electrophotographic process. The image forming unit 9 includes a photosensitive drum 14, which is an image carrier rotatably supported in a clockwise direction in FIG. 1, a charging device 15, a developing device 16, and a cleaning device 17 disposed around the photosensitive drum 14, a transfer roller 18 disposed to face the photosensitive drum 14 with a sheet conveyance path 4 therebetween, and an exposure device (laser scanning unit) 19 disposed above the photosensitive drum 14. A toner container 20 for supplying toner to the developing device 16 as necessary is disposed above the developing device 16.

The photosensitive drum 14 is, for example, an aluminum drum on which a photosensitive layer is laminated, and an amorphous silicon photosensitive member or an organic photosensitive member (OPC photosensitive member) is used as a photosensitive material for forming the photosensitive layer. A scorotron charging device using corona discharge or a contact charging device using a charging roller is used as the charging device 15. By applying a predetermined charging voltage to the charging device 15, the surface of the photosensitive drum 14 is uniformly charged with a predetermined polarity (the same polarity as the toner) and potential.

Next, the surface of the photosensitive drum 14 is exposed to a laser beam from the exposure device 19 based on image data input from a host device such as a personal computer to form an electrostatic latent image in which charging is attenuated, and toner is attached to the electrostatic latent image by the developing device 16 to form a toner image on the surface of the photosensitive drum 14.

The toner image formed on photosensitive drum 14 is transferred by transfer roller 18 to a sheet supplied to a transfer position formed at a nip portion between photosensitive drum 14 and transfer roller 18. The sheet having the toner image transferred thereon is separated from photosensitive drum 14 and conveyed toward fixing unit 10. This fixing unit 10 is disposed downstream of image forming unit 9 with respect to the sheet conveying direction, and the sheet having the toner image transferred thereon in image forming unit 9 is sandwiched and heated by heating roller 21 provided in fixing unit 10 and pressure roller 22 pressed against heating roller 21, and the toner image transferred on the sheet is fixed.

Then, the sheet having passed through the image forming unit 9 and the fixing unit 10 is discharged to the sheet discharge unit 3 by the discharge roller pair 11. On the other hand, the toner remaining on the surface of the photosensitive drum 14 is removed by the cleaning device 17. Then, the photosensitive drum 14 is charged again by the charging device 15, and image formation is performed in the same manner.

Figure 2:
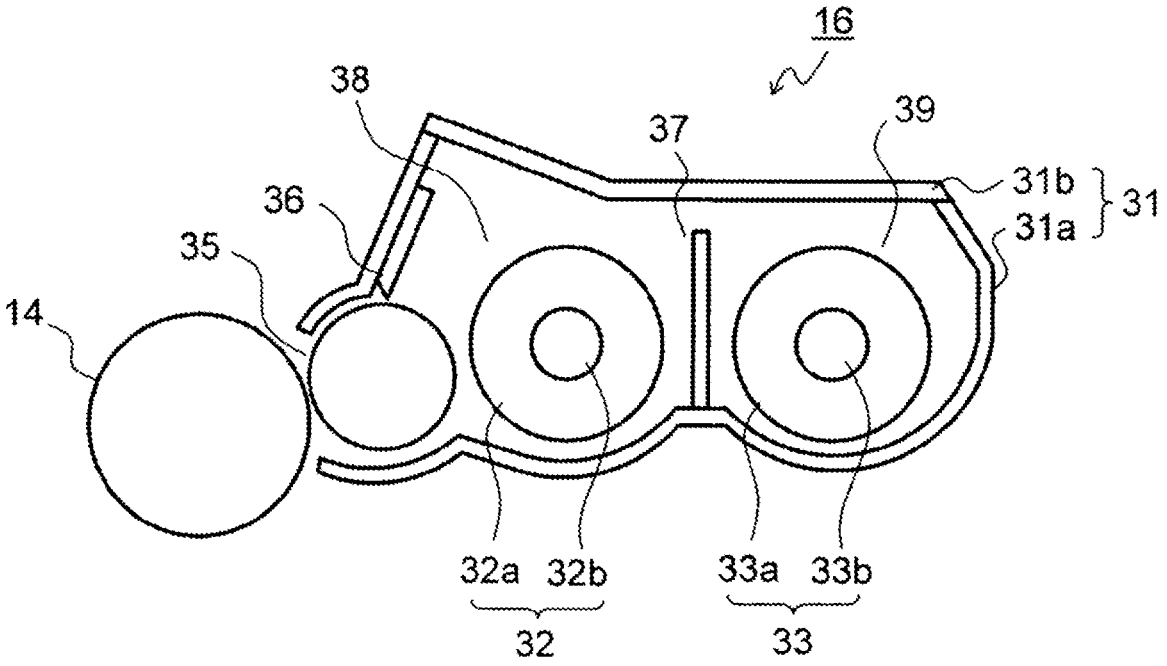
FIG. 2 is a sectional view of a developing device 16 used in the image forming apparatus 100 of the present embodiment.

FIG. 2 is a side sectional view of the developing device 16 mounted in the image forming apparatus 100 of the present embodiment. The developing device 16 is attachable to and detachable from the image forming apparatus 100, and as shown in FIG. 2, first and second stirring and conveying screws 32 and 33, a developing roller 35, and a regulating blade 36 are provided in a developing container 31 including a container body 31*a* in which a magnetic one-component developer (hereinafter, referred to as toner) made of magnetic toner is stored and a cover 31*b* that seals the container body 31*a* so that the toner stored in the container body 31*a* does not leak to the outside.

The inside of the container body 31*a* is partitioned into a first storage chamber 38 and a second storage chamber 39 by a partition wall 37 extending in the longitudinal direction, and a first stirring and conveying screw 32 is arranged in the first storage chamber 38 and a second stirring and conveying screw 33 is arranged in the second storage chamber 39. In addition, the partition wall 37 is not provided at both end portions in the longitudinal direction (direction perpendicular to the paper surface) of the container body 31*a*, and these portions serve as a communication path through which the toner moves between the first storage chamber 38 and the second storage chamber 39.

The first stirring and conveying screw 32 and the second stirring and conveying screw 33 are respectively composed of rotary shafts 32*b* and 33*b* and spiral blades 32*a* and 33*a* integrally formed on the outer peripheral surfaces of the rotary shafts 32*b* and 33*b*, and are rotatably supported in the container body 31*a* so as to be substantially parallel to each other. The first stirring and conveying screw 32 and the second stirring and conveying screw 33 rotate in a predetermined direction to circulate and convey the toner in the first storage chamber 38 and the second storage chamber 39. The cover 31*b* is provided with a toner supply port (not shown) through which the toner is supplied from the toner container 20 (see FIG. 1) so that the toner can be supplied into the container body 31*a* in accordance with the detection result of the toner amount detection sensor 40 (see FIG. 3).

The developing roller 35 is rotatably supported in the first storage chamber 38 so as to be substantially parallel to the first stirring and conveying screw 32 and the second stirring and conveying screw 33. A magnet roller (not shown) formed of a permanent magnet having a plurality of magnetic poles is fixed inside the developing roller 35, and when the developing roller 35 rotates in accordance with the rotation of the photosensitive drum 14, the toner is attached (carried) to the surface of the developing roller 35 by the magnetic force of the magnet roller to form a toner layer. Then, the toner adhering to the developing roller 35 in the predetermined developing area flies to the photosensitive drum 14 due to the potential difference between the surface potential of the photosensitive drum 14 and the developing voltage (for example, DC voltage Vdc=280V, AC voltage Vpp=1.7 kV, frequency 2.3 kHz) applied to the developing roller 35 and adheres to the photosensitive layer, whereby a toner image is formed on the photosensitive drum 14.

The regulating blade 36 regulates the amount of toner supplied to the photosensitive drum 14, that is, the amount of toner attached to the developing roller 35. For example, a magnetic material such as SUS (stainless steel) is used. The regulating blade 36 is disposed so that a predetermined gap is formed between the tip thereof and the developing roller 35, the amount of toner adhering to the developing roller 35 is regulated by the gap between the regulating blade 36 and the developing roller 35 and a magnetic field generated in the gap, and a toner thin layer of several tens of microns is formed on the surface of the developing roller 35.

Figure 3:
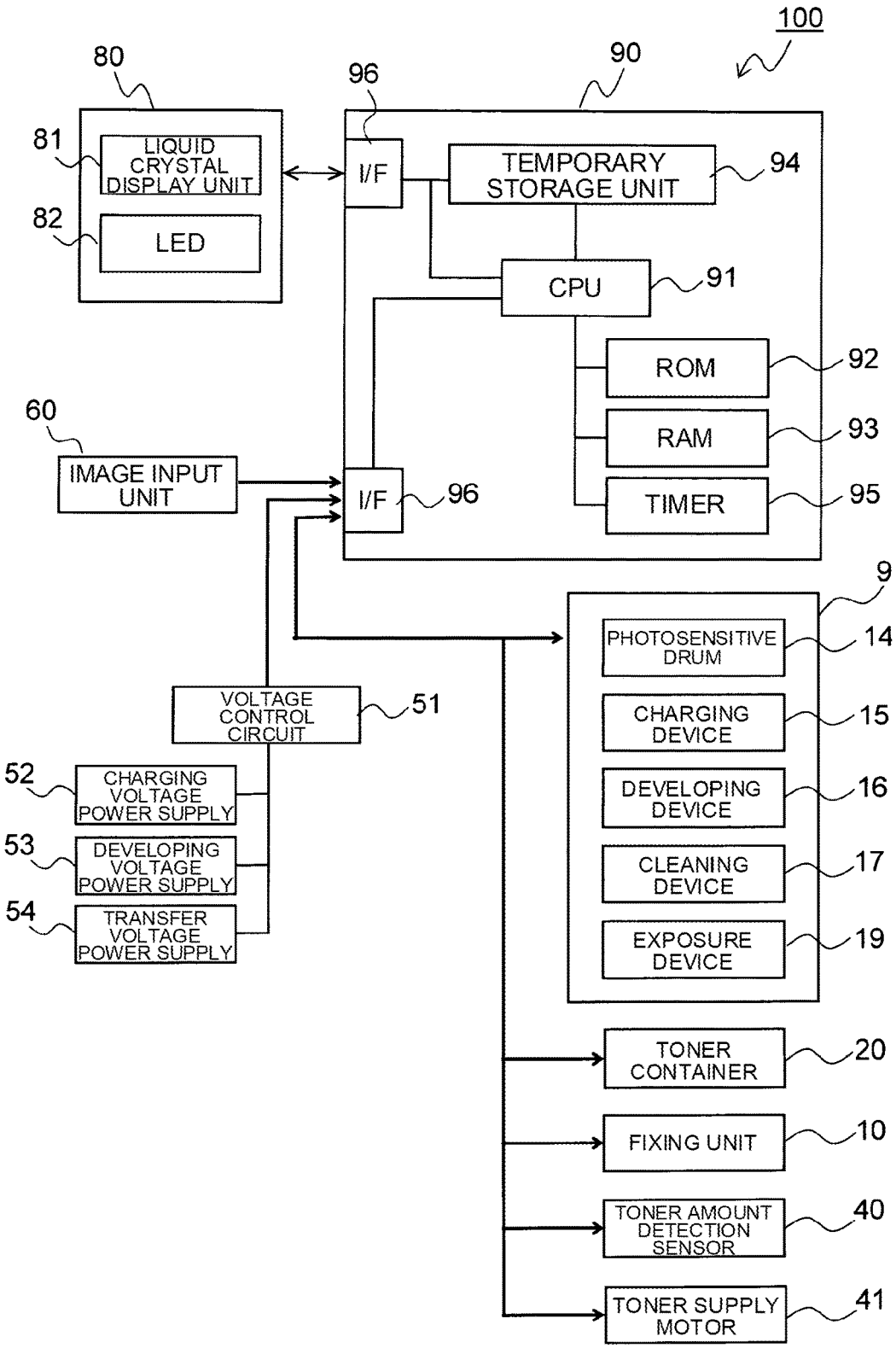
FIG. 3 is a block diagram showing a control path of the image forming apparatus 100 of the present embodiment.

Next, a control path of the image forming apparatus 100 will be described. FIG. 3 is a block diagram showing an example of a control path used in the image forming apparatus 100 of the present embodiment. Since various controls of each unit of the apparatus are performed in using the image forming apparatus 100, a control path of the entire image forming apparatus 100 becomes complicated. Therefore, a portion of the control path necessary for carrying out the present invention will be mainly described.

The control unit 90 includes at least a CPU (Central Processing Unit) 91 as a central processing unit, a ROM (Read Only Memory) 92 as a read-only storage unit, a RAM (Random Access Memory) 93 as a readable and writable storage unit, a temporary storage unit 94 for temporarily storing image data and the like, and a plurality of (here, two) I/Fs (interfaces) 96 for transmitting a control signal to each device in the image forming apparatus 100 and receiving an input signal from the operation unit 80. In addition, the control unit 90 can be disposed at an arbitrary location inside the image forming apparatus 100.

The ROM 92 stores data which are not changed during use of the image forming apparatus 100, such as a control program for the image forming apparatus 100, numerical values required for control, and the like. The RAM 93 stores necessary data generated during the control of the image forming apparatus 100, data temporarily necessary for the control of the image forming apparatus 100, and the like. The RAM 93 also stores an output value of the toner amount detection sensor 40 and the like used for setting a durability correction value at the time of replacement of the developing device 16, which will be described later.

In addition, the control unit 90 transmits a control signal to each part and device in the image forming apparatus 100 through CPU 91 to I/F 96. A signal indicating the state of each part and device and an input signal are transmitted from each part or device to CPU 91 through I/F 96. Examples of the parts and devices controlled by the control unit 90 include the sheet feeding cassette 2, the fixing unit 10, the developing device 16, the exposure device 19, the toner container 20, the toner amount detection sensor 40, the toner supply motor 41, the voltage control circuit 51, the image input unit 60, and the operation unit 80.

The toner amount detection sensor 40 is provided in the vicinity of a mounting portion of the developing device 16 in the image forming apparatus 100, and detects the amount of toner in the developing device 16. In accordance with the detection result of the toner amount detection sensor 40, the toner stored in the toner container 20 (see FIG. 1) is supplied into the developing container 31 via a toner supply port (not shown) provided in the cover 31*b* of the developing container 31. A magnetic permeability sensor that detects the magnetic permeability of the toner in the developing device 16 is used as the toner amount detection sensor 40. The toner amount detection sensor 40 may be disposed on the developing device 16 side.

The toner supply motor 41 supplies the toner stored in the toner container 20 to the developing device 16 at a predetermined speed. In the present embodiment, the magnetic permeability of the developer is detected by the toner amount detection sensor 40, and a voltage value corresponding to the detection result is output to the control unit 90. The control unit 90 determines the amount of toner in the developing device 16 from the output value of the toner amount detection sensor 40, transmits a control signal to the toner supply motor 41 in accordance with the determined amount of toner, and supplies a predetermined amount of toner from the toner container 20 to the developing device 16 (normal supply).

The voltage control circuit 51 is connected to the charging voltage power supply 52, the developing voltage power supply 53, and the transfer voltage power supply 54, and operates these power supplies in response to output signals from the control unit 90. The charging voltage power supply 52 applies a predetermined voltage to the charging device 15, the developing voltage power supply 53 applies a predetermined voltage to the developing roller 35 in the developing device 16, and the transfer voltage power supply 54 applies a predetermined voltage to the transfer roller 18, in response to control signals from the voltage control circuit 51.

The image input unit 60 is a receiving unit that receives image data transmitted from a personal computer or the like. An image signal input from the image input unit 60 is converted into a digital signal and then sent to the temporary storage unit 94.

The operation unit 80 is provided with a liquid crystal display unit 81 and a LED 82 indicating various states, and is configured to indicate the state of the image forming apparatus 100 and to display the image forming state and the number of copies to be printed. Various settings of the image forming apparatus 100 are performed by a printer driver of a personal computer.

In addition, the operation unit 80 is provided with a start button for a user to give an instruction to start image formation, a stop/clear button used to stop image formation or the like, a reset button used to set various settings of the image forming apparatus 100 to a default state, and the like.

In the image forming apparatus 100 of the present embodiment, when the toner in the developing device 16 runs out, a toner installation mode is executed in which the developing device 16 is removed and replaced with an unused developing device 16, and a larger amount of toner is supplied to the developing device 16 than in a case where toner is replenished at the time of image formation (normal supply). Alternatively, even when the developing device 16 is not replaced, for example, when the toner container 20 is replaced and new toner is supplied, the toner installation mode may be executed to stabilize the charged state of the toner. At this time, in a case where the developing device 16 does not have an individual identification function such as an IC tag, it is not possible to determine whether or not the toner in the developing device 16 is an unused product that is empty.

In addition, in the image forming apparatus 100, so-called durability correction is performed in which image forming conditions such as a developing voltage applied to the developing roller 35 and a surface potential of the photosensitive drum 14 are corrected in accordance with a state (cumulative driving time, cumulative number of printed sheets, and the like) of the developing device 16. Here, in order to set the time point at which the developing device 16 is replaced with an unused product and the toner installation mode is executed as the start point (starting point) of the durability correction, it is necessary to reset the durability correction value in accordance with the execution timing of the toner installation mode. However, as described above, when it is not possible to determine whether or not the developing device 16 is an unused product, it is not possible to automatically perform the reset operation of the durability correction value in conjunction with the toner installation mode.

Therefore, in the present embodiment, when the toner installation mode is selected, the presence or absence of the toner in the developing device 16 is detected by the toner amount detection sensor 40. When the toner in the developing device 16 is not detected, it is determined that the developing device 16 is an unused product, and thus the toner installation mode is executed, and the durability correction value is reset. On the other hand, when the toner in the developing device 16 is detected, it is determined that the developing device 16 is a used product (or in use), and thus the toner installation mode is executed without resetting the durability correction value.

Figure 4:
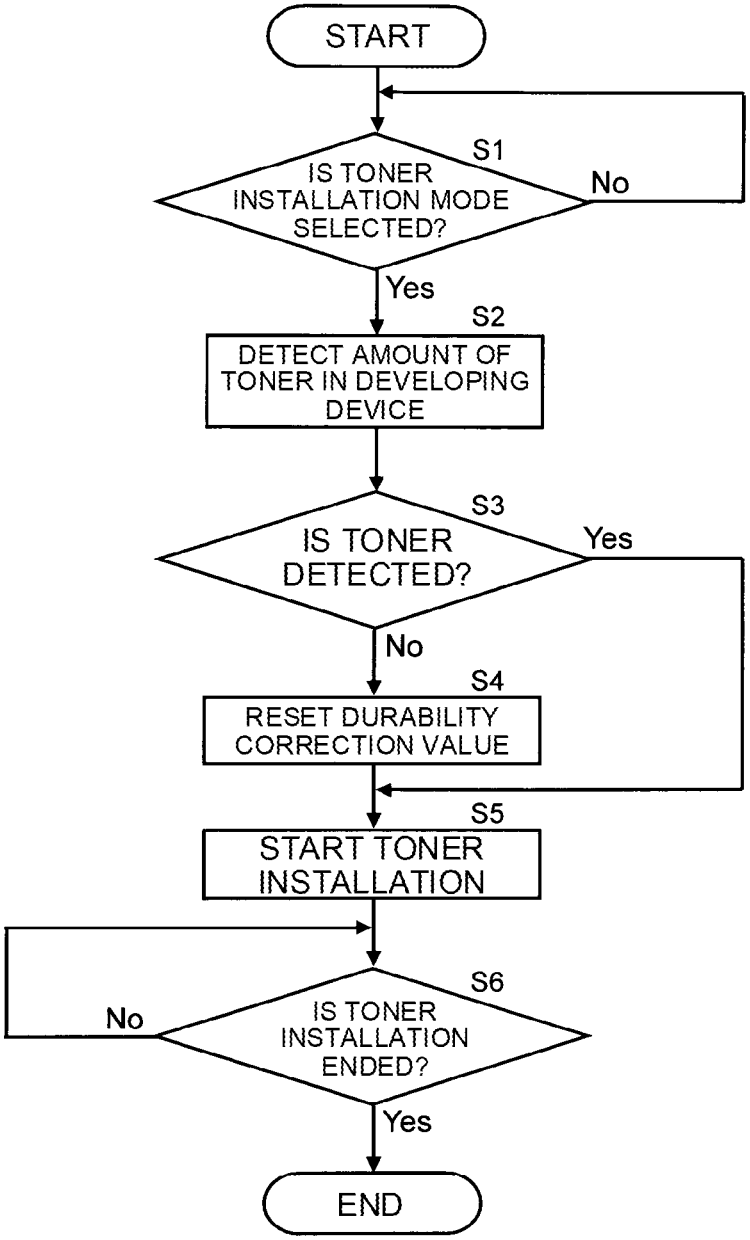
FIG. 4 is a flowchart showing a first control example of the toner installation mode and the reset operation of the durability correction value in the image forming apparatus 100 of the present embodiment.

FIG. 4 is a flowchart illustrating a first control example of the toner installation mode and the reset operation of the durability correction value in the image forming apparatus 100 of the present embodiment. Referring to FIGS. 1 to 3, the execution of the toner installation and the setting procedure of the durability correction value will be described along the steps of FIG. 4.

First, the control unit 90 determines whether or not the toner installation mode is selected (step S1). When the toner installation mode is selected (Yes in step S1), the amount of toner in the developing device 16 is detected by the toner amount detection sensor 40 (step S2). The detection result of the toner amount detection sensor 40 is transmitted to the control unit 90.

Next, the control unit 90 determines whether or not toner is detected by the toner amount detection sensor 40 (step S3). When the toner is not detected in the developing device 16 (No in step S3), it is determined that the developing device 16 is replaced with an unused product, and thus a reset operation for returning the durability correction values to the initial setting is performed (step S4), and a toner installation mode for supplying the toner from the toner container 20 to the developing device 16 is started (step S5).

On the other hand, when the toner is detected in the developing device 16 (Yes in step S3), it is determined that the developing device 16 is replaced with a used product or the developing device 16 in use is not replaced, and the toner installation mode is started without resetting the durability correction values (step S5).

Thereafter, the control unit 90 determines whether or not the toner installation is ended, that is, whether or not the toner amount detection sensor 40 detects that the toner is supplied to a prescribed level (step S6). When the toner is not replenished up to the prescribed level (No in step S6), the toner installation is continued. When the toner is replenished to the prescribed level (Yes in step S6), the process is terminated.

According to the above-described first control example, when the developing device 16 is replaced with an unused product, the durability correction value is automatically reset in conjunction with the toner installation mode. Therefore, even in a case where the replacement operation of the developing device 16 is performed not by a service person but by a user, there is no concern that the user forgets the reset operation of the durability correction value. When the developing device 16 is not replaced with an unused one, the toner installation mode is executed without resetting the durability correction value. Therefore, it is possible to maintain the optimum image forming condition corresponding to the use state of the developing device 16 for a long period of time. In addition, since it is not necessary to provide the developing device 16 with an individual identification function such as an IC tag, the cost of the developing device 16 can be reduced.

When toner is detected in the developing device 16, it can be determined that the developing device 16 is not an unused product. However, it is impossible to determine whether the developing device 16 is in use or a used product. Therefore, there is a possibility that the durability (cumulative driving time from the start of use) of the developing device 16 varies. In the first control example, when it is determined that the developing device 16 is not an unused product, the endurance correction value is not changed. Therefore, the durability correction value is not adjusted to an appropriate value according to the durability of the developing device 16.

In addition, since the fluidity of the toner deteriorates as the toner is used long, the change in the sensor output value during one cycle of stirring by the first stirring and conveying screw 32 and the second stirring and conveying screw 33 tends to increase. This is considered to be due to the following reasons. When the fluidity of the toner decreases, the toner particles adhere to each other and move in a lump. Therefore, aggregation of the toner particles proceeds in a portion where the toner is densely present, and the sensor output value easily increases compared to the initial stage of use. On the other hand, in a portion where the amount of toner is small, the amount of toner flowing into the detection surface of the toner amount detection sensor 40 is small, and the sensor output value is likely to decrease compared to the initial stage of use. As a result, the maximum value of the sensor output value tends to be larger after long-use than at the initial stage of use.

Therefore, in a second control example to be described later, when it is determined that the toner is present in the developing device 16 and the developing device 16 is not an unused product, the sensor output value of the toner amount detection sensor 40 within a predetermined time is compared before and after the toner installation. The durability of the toner is estimated based on the comparison result, and the durability correction value is corrected.

Figure 5:
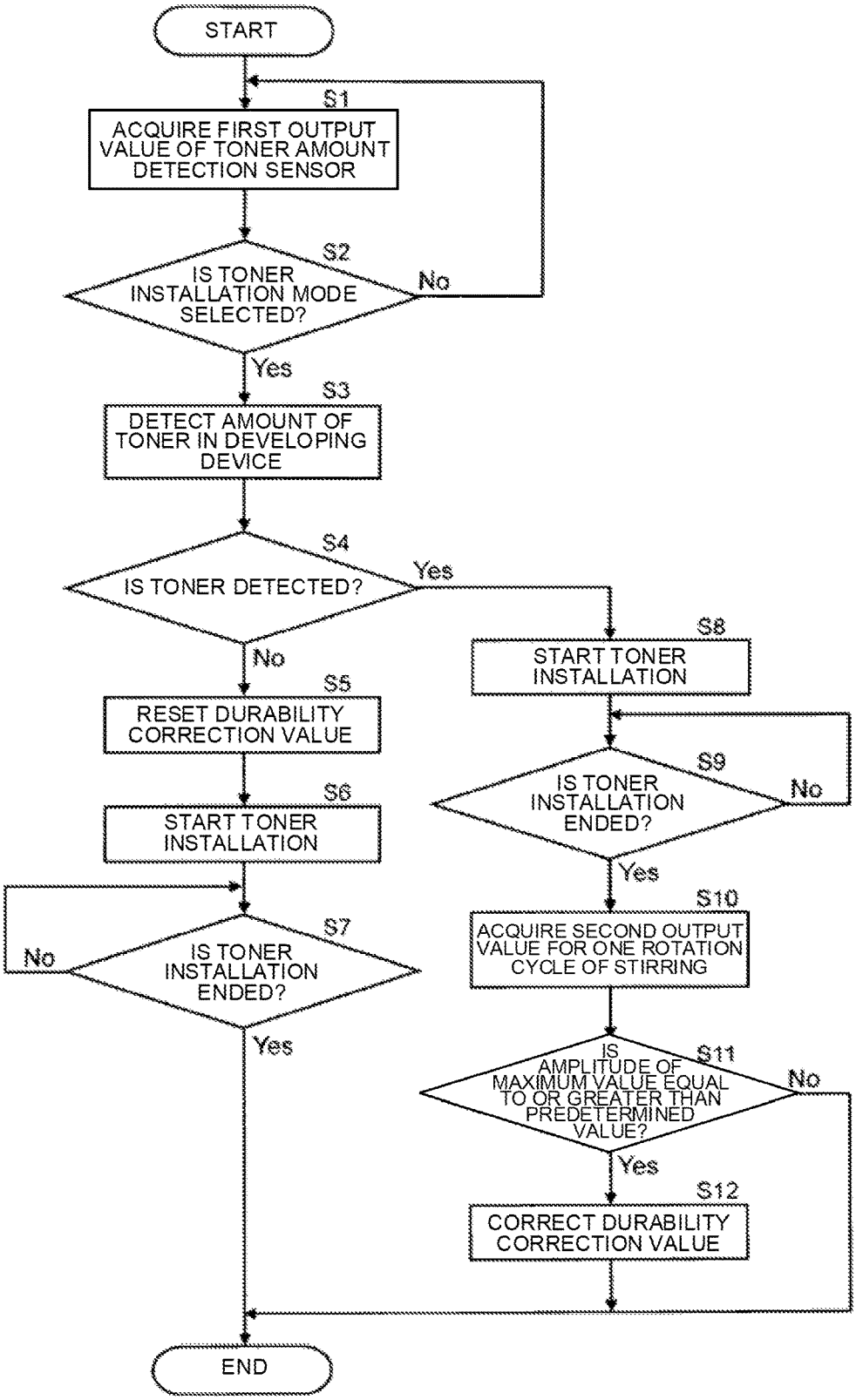
FIG. 5 is a flowchart showing a second control example of the toner installation mode and the reset operation of the durability correction value in the image forming apparatus 100 of the present embodiment.

FIG. 5 is a flowchart illustrating a second control example of the toner installation mode and the reset operation of the durability correction value in the image forming apparatus 100 of the present embodiment. Referring to FIGS. 1 to 3, the execution of the toner installation and the setting procedure of the durability correction value will be described along the steps of FIG. 5.

First, the output value (first output value) of the toner amount detection sensor 40 within a predetermined time before the toner installation mode is selected is acquired (step S1). Since the output value of the toner amount detection sensor 40 periodically changes following the rotation cycle of the first stirring and conveying screw 32 and the second stirring and conveying screw 33, it is preferable to acquire at least the output value of the first stirring and conveying screw 32 and the second stirring and conveying screw 33 for one rotation cycle (equivalent to one rotation). The acquired first output value is stored in RAM 93.

Next, the control unit 90 determines whether or not the toner installation mode is selected (step S2). When the toner installation mode is not selected (No in step S2), the process returns to step S1, and the acquisition of the first output value of the toner amount detection sensor 40 is continued.

When the toner installation mode is selected (Yes in step S2), the amount of toner in the developing device 16 is detected by the toner amount detection sensor 40 (step S3).

The detection result of the toner amount detection sensor 40 is transmitted to the control unit 90.

Next, the control unit 90 determines whether or not toner is detected by the toner amount detection sensor 40 (step S4). When the toner is not detected in the developing device 16 (No in step S4), it is determined that the developing device 16 is replaced with an unused product, and thus a reset operation for returning the durability correction values to the initial setting is performed (step S5), and a toner installation mode for supplying the toner from the toner container 20 to the developing device 16 is started (step S5).

Thereafter, the control unit 90 determines whether or not the toner installation is ended (step S7). When the toner is not replenished up to the prescribed level (No in step S7), the toner installation is continued. When the toner is replenished to the prescribed level (Yes in step S7), the process is terminated.

On the other hand, when toner is detected in the developing device 16 in step S4 (No in step S4), the toner installation mode is started without resetting the durability correction values (step S8). Next, the control unit 90 determines whether or not the toner installation is ended (step S9). When the toner is not replenished up to the prescribed level (No in step S9), the toner installation is continued.

When the toner is supplied to the prescribed level and the toner installation mode is ended (Yes in step S9), the output value (second output value) of the toner amount detection sensor 40 for one rotation cycle of the first stirring and conveying screw 32 and the second stirring and conveying screw 33 is acquired (step S10). Then, the second output value is compared with the first output value stored in RAM 93, and it is determined whether the amplitude of the maximum value (the difference of the maximum values) is equal to or greater than a predetermined value (step S11).

When the amplitude of the maximum value is equal to or larger than the predetermined value (Yes in step S11), it is determined that the durability of the toner has progressed, and the durability correction values are corrected (step S12). If the maximum amplitude is less than the predetermined value (No in step S11), the process ends without correcting the durability correction values.

For example, the threshold value of the amplitude of the maximum value of the sensor output value for correcting the durability correction value is assumed to be 20%. When the average value (Ave.) and the maximum value (Max.) of the first output values acquired before the execution of the toner installation mode are Ave. 100 and Max. 120, respectively, and the average value and the maximum value of the second output values acquired after the execution of the toner installation mode are Ave. 102 and Max. 125, respectively, the amplitude of the maximum value is $(125-120)/120\times 100\approx 4.2(\%)$, and the amplitude is less than 20%, and thus the durability correction value is not corrected.

On the other hand, when the average value and the maximum value of the second output value are Ave. 101 and Max. 159, respectively, the amplitude of the maximum value is $(159-120)/120\times 100=32.5(\%)$, and since the amplitude is 20% or more, the durability correction value is corrected.

Although the necessity of correction of the durability correction value is determined by comparing the maximum values of the first output value and the second output value acquired before and after execution of the toner installation mode, the necessity of correction of the durability correction value may be determined by comparing the peak-to-peak value (difference between the maximum value and the minimum value) of the first output value and the second output value instead of the maximum value.

According to the above-described second control example, when the developing device 16 is replaced with an unused product, the durability correction value is automatically reset in conjunction with the toner installation mode. Therefore, similarly to the first control example, even in a case where the replacement operation of the developing device 16 is performed not by a service person but by a user, there is no concern that the user forgets the reset operation of the durability correction value.

When the developing device 16 is not replaced with an unused product, the sensor output value of the toner amount detection sensor 40 is compared before and after the toner installation, and the durability correction value is corrected by estimating the durability of the toner based on the comparison result. Thus, since the durability correction value can be corrected in accordance with the durability of the toner, it is possible to more accurately maintain the optimum image forming condition in accordance with the use situation of the developing device 16 for a long period of time.

The present invention is not limited to the above embodiments, and various modifications can be made without departing from the scope of the present invention. For example, unless otherwise specified, the dimensions, materials, shapes, relative arrangements, and the like of the components described in the above embodiments are not intended to limit the scope of the present invention, and are merely explanatory examples.

Further, the present invention is not limited to the monochrome printer shown in FIG. 1, and it is needless to say that the present invention can be applied to various image forming apparatuses including a developing device capable of supplying a one-component developer, such as an analog type monochrome copying machine, a rotary type or tandem type color copying machine, a color printer, a copying machine such as an analog type monochrome copying machine, and a facsimile.

The present disclosure is applicable to an image forming apparatus capable of supplying toner to a detachable developing device. According to the present invention, it is possible to provide an image forming apparatus capable of appropriately changing a set value of durability correction based on a toner amount in a developing device at the time of execution of toner installation.

What is claimed is:

1. An image forming apparatus comprising:

an image carrier having a surface on which a photosensitive layer is formed;

a replaceable developing device that includes a developing container in which a one-component developer including a magnetic toner is stored and a toner bearing member that bears the toner in the developing container, and that forms a toner image by causing the toner to adhere to an electrostatic latent image formed on a surface of the image carrier;

a toner amount detection sensor that detects an amount of toner in the developing device;

a toner container that stores the toner to be supplied to the developing device;

a control unit that controls supply of the toner from the toner container to the developing device; and a storage unit that stores a detection result of the toner amount detection sensor, wherein the image forming apparatus performs durability correction in which an image forming condition is corrected in accordance with a cumulative driving time from a start of use of the developing device or a cumulative number of printed sheets, wherein the control unit is operable to execute:

a normal supply of supplying the toner from the toner container to the developing device based on a detection result of the toner amount detection sensor; and a toner installation mode in which a larger amount of the toner than the normal supply is supplied from the toner container to the developing device, wherein the control unit detects an amount of toner in the developing device by the toner amount detection sensor during execution of the toner installation mode, wherein when the toner is not detected in the developing device, a durability correction value used for the durability correction is reset and the toner installation mode is executed, and when the toner is detected in the developing device, the toner installation mode is executed without resetting the durability correction value, wherein the control unit stores in the storage unit, as a first output value, an output value of the toner amount detection sensor within a predetermined time, the output value being acquired before the execution of the toner installation mode, and wherein when the toner is detected in the developing device during execution of the toner installation mode, an output value of the toner amount detection sensor within the predetermined time after execution of the toner installation mode is acquired as a second output value, and the durability correction value is corrected when a difference between the first output value and the second output value is equal to or larger than a predetermined value.

2. The image forming apparatus according to claim 1, wherein the developing device includes a stirring and conveying member that is rotatably disposed in the developing container and conveys the toner in the developing container while stirring the toner, and the control unit acquires, as the first output value and the second output value, output values of the toner amount detection sensor for at least one rotation cycle of the stirring and conveying member.

3. The image forming apparatus according to claim 1, wherein the control unit corrects the durability correction value when a difference between a maximum value of the first output value and a maximum value of the second output value is greater than or equal to a predetermined value.

4. The image forming apparatus according to claim 1, wherein the control unit corrects the durability correction value when a difference between a peak-to-peak value of the first output value and a peak-to-peak value of the second output value is greater than or equal to a predetermined value.

* * * * *